United States Patent [19]

Benson

[11] Patent Number: 5,026,321

[45] Date of Patent: Jun. 25, 1991

[54] COIN DISPENSER

[76] Inventor: Anders B. Benson, % Linus Huang, P.O. Box 10160, Taipei, Taiwan

[21] Appl. No.: 451,614

[22] Filed: Dec. 18, 1989

[51] Int. Cl.[5] ..... G07D 1/08

[52] U.S. Cl. ..... 453/54; 206/0.84

[58] Field of Search ..... 453/48–54; 221/279, 307, 309; 206/0.83, 0.84

[56] References Cited

U.S. PATENT DOCUMENTS

| | | | |
|---|---|---|---|
| 1,235,910 | 8/1917 | Miller | 453/54 |
| 1,454,445 | 5/1923 | Lieberman | 453/54 |
| 2,334,016 | 11/1943 | Loesch | 453/54 |
| 2,654,376 | 10/1953 | Hultberg | 453/54 |

FOREIGN PATENT DOCUMENTS

| | | | |
|---|---|---|---|
| 458976 | 3/1951 | Italy | 453/54 |

*Primary Examiner*—F. J. Bartuska

[57] ABSTRACT

A coin dispenser for accomodating and storing coins is made of plastics and comprises a plurality of coin compartments, each receiving a stack of coins of a certain denomination. The stack is retained by upper supporting flanges against which the stack is urged by a spring. The top coin of each stack can be pushed out from the dispenser by a user's finger, preferably the user's thumb and, reversely, a coin can be inserted into the dispenser in a similar manner. The arrangement is such that from a central depression or well free pushing-out paths are formed across the compartments between the supporting flanges. In this way the back or inner edges of the top coins are readily accessible for pushing out. In addition, the dispenser is designed in such a way that in their dwelling position all uppermost coins are prevented automatically from sliding out unintentionally from the dispenser.

2 Claims, 3 Drawing Sheets

COIN DISPENSER

BACKGROUND OF THE INVENTION

The present invention relates to a coin dispenser, i.e. a purse or holder for coins in a form of a rigid casing, preferably of plastics, having compartments for the respective kind of coins, wherein the coins can be inserted and removed by hand.

Conventional coin dispensers are wellknown in several forms, for instance, as taught by U.S. Pat. No. 2,654,376. They have common features that the coins are continuously fed upwards in their compartments by spring means, to meet at the top end of the compartment a supporting ledge, which engages the top coin along the periphery thereof, however, only along a part of this periphery, so that an opening for feeding in and pushing out is left at the top end of the compartment. It is now known to use finger operated mechanical means to push out the top coin of the stack of coins, but also simpler structures have been proposed, wherein the coins are put in and put out entirely by means of the fingers, for example, in the device according to the U.S. Pat. No. 2,654,376. A problem here is that one has to rely completely on the friction between the finger and the coin to be pushed out. In certain cases this friction is too low in order that the coin be moved, that is, too low to overcome the friction force appearing between the coin and the supporting ledge and which is conditioned by the force exercised by the feeding spring. On the other hand there is also a risk that coins be pushed off unintentionally from the box while it is carried in one's pocket, for example by the action of other objects in the pocket.

In U.S. Pat. No. 2,654,376, even the spring 12 provided in the coin socket may help push the coin outwardly for use, the spring 12 will exert an elastic force laterally urging an uppermost coin outwardly to easily push out the coin unintentionally.

SUMMARY OF THE INVENTION

One object of the present invention is to provide a coin dispenser by making the inner edge of the top coin in each compartment accessible to the pushing finger, primarily the thumb, at the same time it is ensured that the coin compartments can be provided side by side in the common casing or housing in such a way that the coins obtain sufficient support by the cooperating supporting ledges and are securely held in their compartments. According to the invention a coin casing or coin dispenser in accordance with the above is provided wherein the coins are put in and pushed out entirely by means of the fingers and without any mechanical operating means, to eliminate the inconveniences as abovementioned.

DETAILED DESCRIPTION

As shown in FIGS. 1–10, there is provided with a single coin compartment 10 with accessories, which compartment is component of a coin dispenser according to the invention. It should be noted that only one compartment is shown, inasmuch as all compartments of the dispenser are designed in accordance with the same principle and exhibit the same physical structure which can be adjusted to be in commensuration with the types of the coins to be stored.

Figure 3:
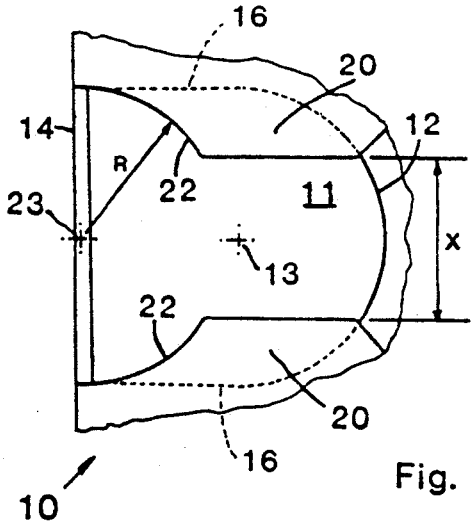
FIG. 3 is a top view of the compartment as viewed from III—III direction as shown in FIG. 1.
Figure 4:
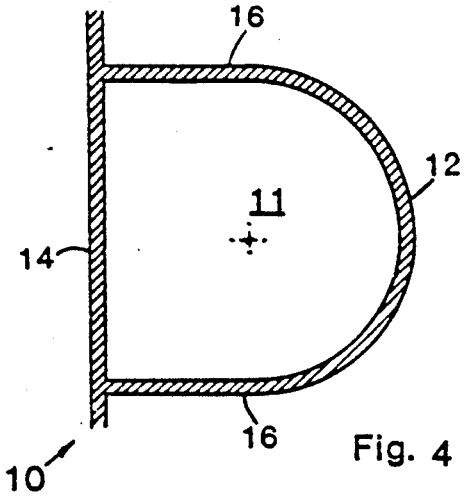
FIG. 4 is a cross sectional drawing of the present invention as viewed from IV—IV direction of FIG. 1.
Figure 7:
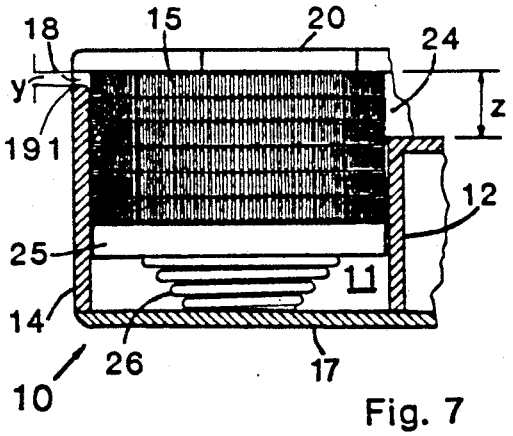
FIG. 7 shows a vertical section through the compartment, completed with the feeding means and a plurality of coins received in the compartment.
Figure 8:
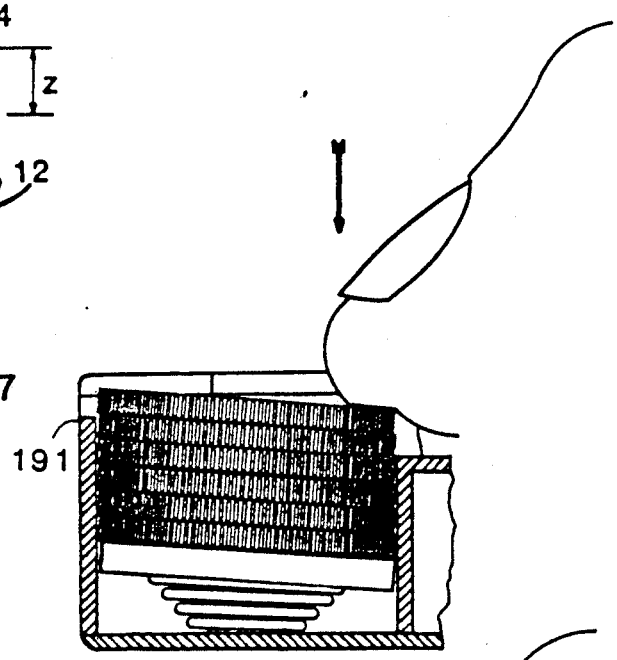
FIGS. 8–10 illustrate how a coin is removed from and inserted into the compartment.
Figure 9:
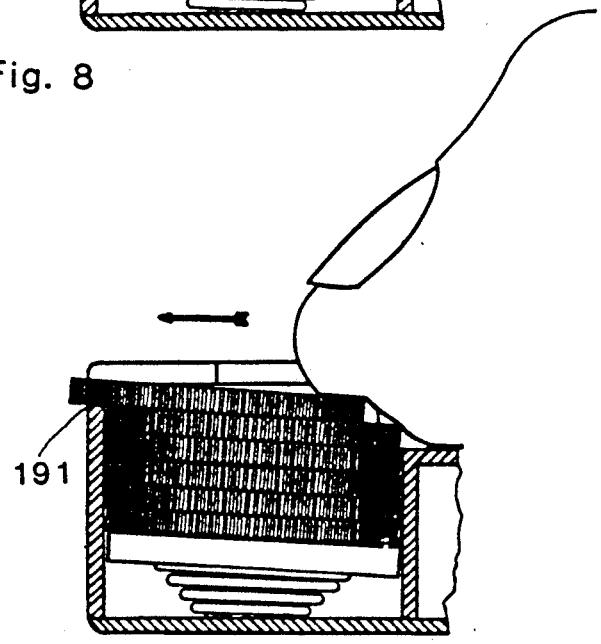
Figure 10:
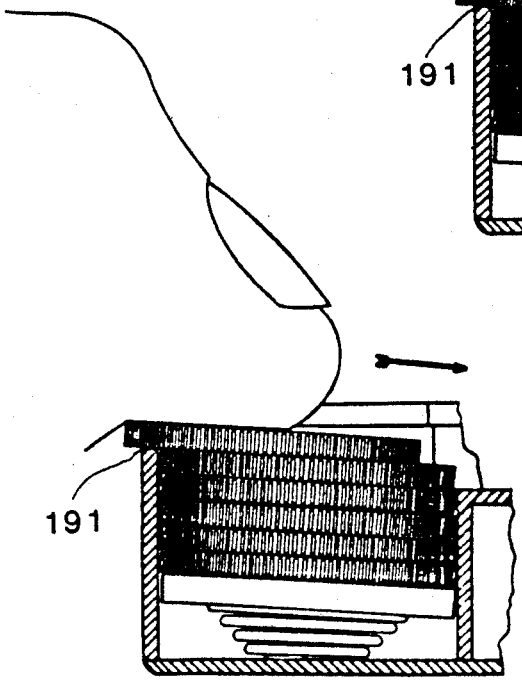

Each compartment comprises a recess or cell 11 for receiving a stack of coins 15 (see FIG. 7). As shown in FIG. 4 the cell is defined by an inner half-circular wall 12 and an outer wall 14 forming part of the outside of the casing, which wall can be straight, as shown in FIGS. 3 and 4, but also curved as shown at 14' in FIG. 5. The half-circular inner wall 12 is tangentially extended to form two straight portions 16 to be connected to outer wall 14, as clearly shown in FIG. 4. In the design according to FIG. 5 these straight, tangential portions 16' can of course be made shorter. The cell is defined downwards by a bottom 17.

Figure 1:
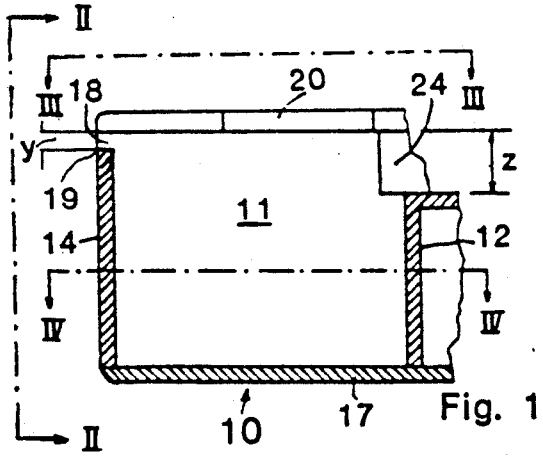
FIG. 1 shows a vertical section of the present invention when viewed along line I—I of FIG. 2 through a single coin compartment of a coin dispenser.
Figure 2:
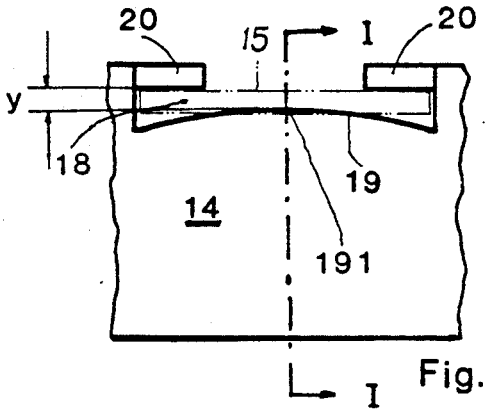
FIG. 2 shows a front view of the compartment when viewed from II—II direction of FIG. 1.

One of the determining features of the invention is illustrated in FIG. 2, which shows the compartment as seen straight from the front. As can be seen the outer wall 14 is formed with a curved top edge 19 having a central apex portion 191 formed on a central portion of the top edge 19. This will function as an automatic locking means for the coins in the compartment, as will be described.

The coins received in the cell 11 are pressed upwards towards two opposing supporting ledges 20 as shown in FIG. 3. The two ledges 20 extend from the rear wall 12 of the cell 11 towards the outer wall 14 and are separated by a distance x defined therebetween. The top edge 19 of the outer wall 14 defines an opening 18 with the underside of the ledges for pushing in and out of the coins through the opening 18. A distance y is projectively defined between an underside of the ledges 20 and the central apex portion 191 which is slightly smaller than a thickness or height of a coin (an uppermost coin) stored in the cell 11.

It is noted that the supporting ledges 20 are provided with circular recesses at this entrance/exit opening 18, which recesses form guiding edges 22 having substantially the same radius R as that of the coin. The opening 18 intersecting the two guiding edges 22 preferably has a width slightly larger than a diameter of a coin stored in the cell 11 with two opposite ends of the opening 18 being tangentially connected to the two recessed guiding edges 22. The common center 23 of the guiding edges 22 lies at a distance from the center 13 of the cell equal to or, preferably, somewhat greater than R. This means that a coin 15 first slides in across the stack of coins until it meets the guiding edges 22; hereupon the stack is depressed and the coin is pushed in under the supporting edges 20 through the opening 18 until it meets the opposite circular wall 12 of the cell. It is noted here that between the supporting ledges 20 the rear wall 12 is lowered a distance z to form a rear depression or opening 24, see FIGS. 1 and 7, so that the coin inserted only strikes those parts of the rear wall 12 which are defining said opening. In consequence herewith a central part of the rear edge of the coin becomes freely accessible for the subsequent pushing out.

Figure 6:
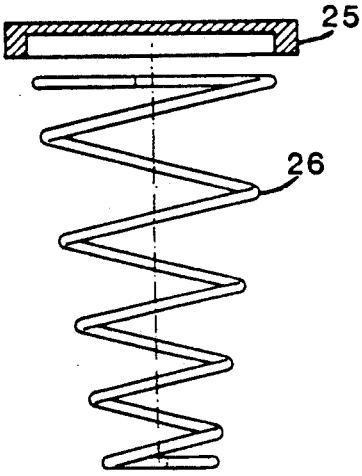
FIG. 6 shows a feeding spring with a cooperating feeding disc accommodated in the compartment.

In FIG. 6 the feeding means of the cell is shown, comprising a disc 25 and a feeding spring 26, the spring in this case being a simple conical spring, but it can also be formed otherwise, e.g. as a double cone (hourglass shape).

FIG. 7 illustrates a complete compartment 10, partly filled of coins 15, in a coin dispenser according to the invention. In the coin recess or cell 11 of the compartment the feeding disc 25 is accommodated with its spring 26 supported against the bottom 17 of the cell. The stack of coins is pushed upwards towards the supporting ledges 20 and it can be seen that, either, a fresh coin can be introduced from top left, as seen in the figures, and be pushed in under the supporting ledges 20 through the entrance 18 while the stack of coins is depressed. Or, reversly, the top coin 15 can be pushed out by the thumb engaging the right edge of the coin through the rear opening 24; as can be seen (e.g. in FIGS. 3 and 5) there is formed a free path of width x between the supporting ledges 20 for the pushing out operation.

Figure 5:
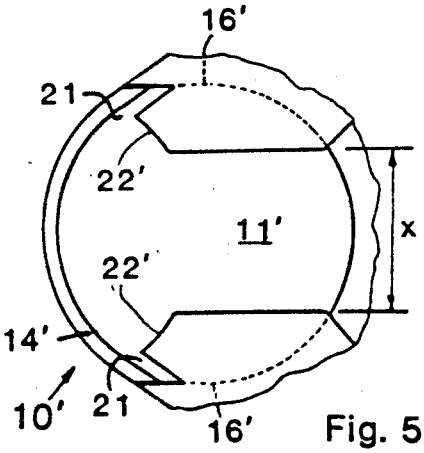
FIG. 5 and 5*a* show several forms of the compartment as modified from that as shown in FIG. 3.
Figure 5A:
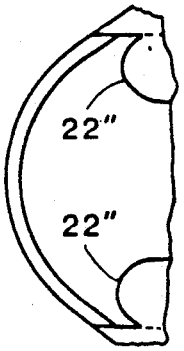

The fact that the half-circular rear wall 12 of each coin cell 11 merges in straight portions 16 ending at the outer wall 14 is significant from the manufacturing point of view, in particular when the outer wall is curved as 14' according to FIG. 5. As already mentioned the dispenser is preferably made of plastics and it is then practical to make the walls and supporting ledges of the dispenser integrally by injection molding, after which the bottom 17 is secured in a suitable manner. The entrance/exit opening 18 must have a width corresponding to the diameter and preferably slightly larger than the diameter of the coin, and to meet this condition and to make it possible at the same time to manufacture the dispenser in a simple injection molding tool the supporting ledges 20 are formed with a gap 21 at the outer wall 14' as shown in FIG. 5. In this connection it is pointed out that it is not necessary to provide the above mentioned guiding edges at the entrance to the compartment, designated 22' in FIG. 5, in the form of part-circular edges, as disclosed in connection with FIG. 3. They can also be provided in the form of rounded formations, as shown in FIG. 5*a* at 22''.

With respect to the automatic locking of the coins in their compartments to prevent unintentional expelling, as mentioned in the aforegoing, this feature is clearly illustrated in FIG. 7 and 2, where it can be seen how the top coin 15 in the compartment is locked in its normal position by the apex portion 191 of the top edge 19 of the front or outer wall 14, the edge preventing the coin from sliding out. But this locking action is automatically eliminated when the coin is actually to be pushed out from the box, see FIG. 8. As previously described the invention has the specific advantage that the back or inner edge of all coins is accessible for safe and easy pushing out, e.g. by means of the thumb. But in doing so it is unavoidable, see FIG. 8, that the thumb at the same time will exert a downwardly directed force, as indicated by an arrow. This means that the stack of coins will tilt a little, which in turn brings with it that the front edge of the top coin is elevated above the edge 19 of the compartment, to allow the coin to be readily pushed out across this edge, see FIG. 9. At the reverse operation, when the coin is inserted into the box, see FIG. 10, it slides in over the edge 19 to snap down inside of the same, and the situation in accordance with FIG. 7 will be restored.

Figure 11:
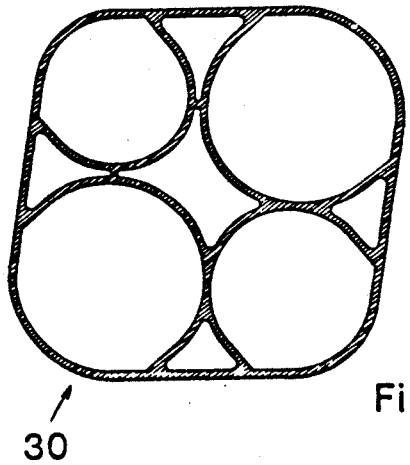
FIG. 11 shows a horizontal cross section through a coin dispenser according to the invention having four compartments.
Figure 12:
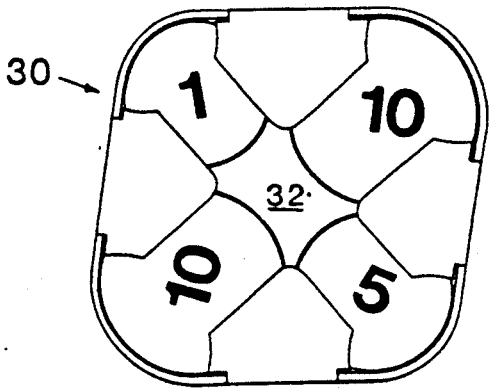
FIG. 12 shows a plan view of a dispenser as shown in FIG. 11 in real size.

In FIGS. 11 and 12 there is shown (in real size) an example of a simple coin dispenser 30 according to the invention, which is composed of four coin compartments according to the aforegoing. Thus FIG. 11 shows a horizontal cross section through the dispenser, illustrating the relative position of the four compartment cells. FIG. 12 shows the complete dispenser with its feeding means inserted: the feeding discs being marked with the respective coin denomination. From the figure it can be seen how the coins can be fed into and removed from the dispenser at the four corners, and in the central part of the dispenser there is formed a recessed portion or well 32. From this well 32 all coins are readily accessible at their rear edges for pushing out.

Figure 13:
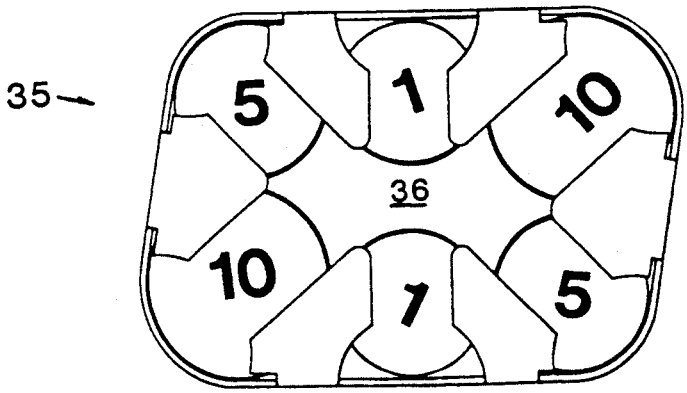
FIG. 13 shows a plan view, likewise in real size, of a further embodiment having six compartments.

FIG. 13 shows, likewise in real size, a dispenser 35 corresponding to the dispenser 30 according to FIGS. 11 and 12 but expanded to include two further compartments, which will then have their entrance/exit openings located at the longsides of the dispenser. Also here a central well 36, is formed, from which the rear or inner edges of the coins are readily accessible.

Figure 14:
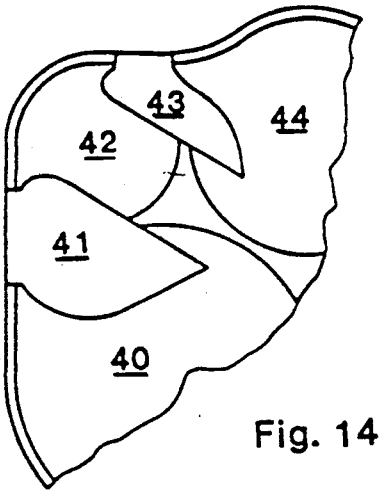
FIGS. 14 and 15 illustrate schematically how certain problems concerning the cooperation of the compartments can arise and be solved in accordance with the present invention.

FIG. 14 illustrates how a complication can arise in certain cases, in particular when compartments having a small diameter are located adjacent other compartments of larger diameter. In this cases coin compartment 42 of a comparatively small diameter is situated at a corner of a coin dispenser, surrounded by two other compartments 40 and 44 of large diameter. The smaller compartment 42 has a supporting ledge 41 in common with the compartment 40 and its opposite supporting ledge 43 in common with the compartment 44, as clearly seen in FIG. 14. But if the ledges are formed as described above, that is, their edges at each compartment extending oppositely with one another to form across each compartment a free path for inserting and removing the coins, the geometrical conditions will obviously give the consequence that the ledges 41 and 43 will be cut off to form sharp tips over the compartments 40 and 44, as shown in FIG. 14. This is very unsuitable and inconvenient as the coins will receive, on the one hand, insufficient support, especially at the compartment 44 and, on the other hand, the tips give an uncomfortable feeling to the user's fingers, and if the tips are rounded in order to reduce this discomfort, the support of the coins will obviously be further impaired.

Figure 15:
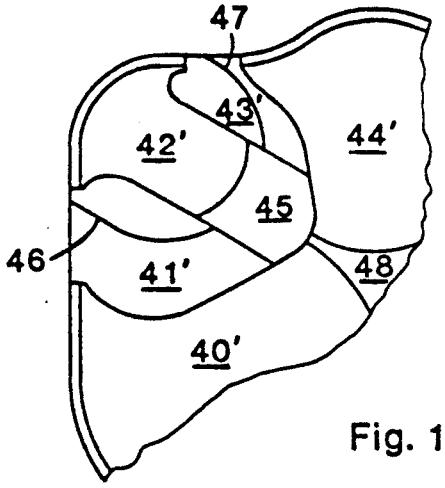
Figure 16:
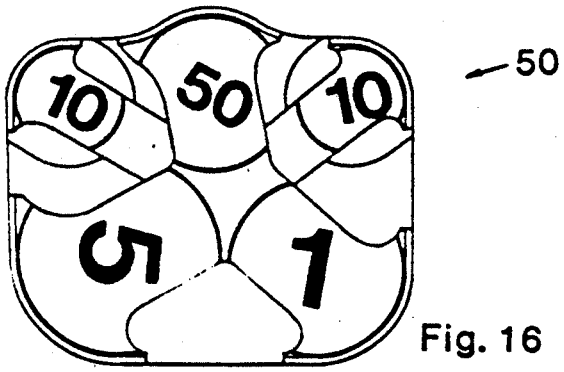
FIG. 16 shows a plan view in real size of a coin dispenser having five compartments formed in accordance with the invention and with said cooperation problems solved.

FIG. 15 illustrates how this problem can be solved in a simple manner. The compartment 42 of FIG. 14 is quite simply made somewhat higher, so that its ledges 41 and 43 are raised a little within the area above the cell in the compartment 42, see FIG. 15, where lines 46 and 47 indicate how those portions of the ledges, now designated 41' and 43', which are above the cell of the compartment 42' are elevated, so that the top coin in this compartment will lie a little higher up. At the same time the ledges 41' and 43' are united by a bridge wherein a path 45 is recessed, whose edges form inner extensions of the ledge edges above compartment 42'. The path 45 ends in the central well 48, so in this way the inner edge of the top coin in the compartment 42' will still be readily accessible for pushing off in the same way as the inner edges of coins in compartments 40' and 44' are accessible. The coins are fully supported at the same time as pointing tips are eliminated. In FIG. 16 there is shown, in real size, an example of a complete coin dispenser 50 designed in this way; the dispenser being shown with the feeding discs inserted, marked with the coin denomination for which the respective compartment is intended. It is noted that in the embodiments of FIGS. 14–16 the front guiding edges of ledges 41, 43 are rounded, as shown in FIG. 5*a*.

As previously pointed out the coin dispensers illustrated are only examples, and by applying the shown and illustrated principle for designing the individual coin compartments, coin dispensers of various types and for different denominations of coins can be designed within the scope of the appended claims.

I claim:

1. A coin dispenser in the form of a plastic casing of pocket size for accommodating and storing coins comprising a plurality of individual coin compartments (10) each coin compartment having its central portion formed with a chamber or cell (11) for receiving a stack of coins (15) of a specific denomination or value, each compartment being defined by a bottom (17), a plurality of surrounding walls (12, 14, 16) including an outer wall (14) and a pair of supporting ledges (20) formed on a top portion of said compartment, against which ledges the stack of coins is urged by a spring means (25, 26) retained on the bottom (17) of the compartment, each said compartment having an entrance and exit opening (18) for feeding coin therein or pushing out coin therefrom formed as a groove or slot directed outwardly, a plurality of said coin compartments (10) being coordinated to integrally form the coin dispenser with each said compartment (10) being formed by integrating each said bottom (17), said surrounding walls (14, 14', 16, 12) and said supporting ledges (20);

each said coin compartment (10) having two cantilevered supporting ledges (20) respectively formed on two opposite upper side portions of the compartment defining a path x between the two ledges (20) for revealing a central portion of a top coin of the stack of coins stored in the compartment;

said entrance and exit opening (18) of each said compartment recessed and lowered from two outer or front ends of the two ledges (20);

a push opening (24) recessed and lowered from two inner or rear ends of the two ledges (20) of each compartment through which push opening (24) the stack of coins is easily accessible for pushing out the coins;

said supporting ledges (20) of each compartment having their front or outer ends formed with guiding edges (22) for leading the coins into the compartment;

a central well (32; 36) formed in an upper central portion of the coin dispenser communicated with each said inner push opening (24) of each coin compartment, adapted for the pushing out of the coins from the compartment by a user's finger preferably his or her thumb, the improvement which comprises:

said outer wall (14) of each said compartment (10) formed with a curved top edge (19) having a central apex portion (191) formed on a central portion of said top edge (19), a distance y projectively defined between an underside of said ledges (20) and said apex portion (191) being slightly smaller than a height or a thickness of a coin (15), especially an uppermost coin, stored in said cell (11) so as to prevent an unintentional lateral sliding out of the uppermost coin from the stack of coins stored in the cell.

2. A coin dispenser according to claim 1, wherein a rear wall (12) of each coin compartment (10) having a cross section of semi-circular shape has it two outer end portions tangentially formed with two flat, parallel wall portions (16) perpendicular to and secured to an outer wall (14, 14') of the coin compartment.

* * * * *